US005228619A

United States Patent [19]

Yano et al.

[11] Patent Number: 5,228,619

[45] Date of Patent: Jul. 20, 1993

[54] THERMAL EXPANSION VALVE

[75] Inventors: Masamichi Yano, Tokyo; Kazuhiko Watanabe, Sagamihara; Tetsurou Ikoma; Takashi Okayama, both of Kawasaki, all of Japan

[73] Assignee: Fuji Koki Manufacturing Co., Ltd., Tokyo, Japan

[21] Appl. No.: 967,339

[22] Filed: Oct. 28, 1992

[30] Foreign Application Priority Data

May 15, 1992 [JP] Japan ..... 4-123499

[51] Int. Cl.[5] ..... F25B 41/04

[52] U.S. Cl. ..... 236/92 B; 236/99 R

[58] Field of Search ..... 62/225; 236/92 B, 99 R

[56] References Cited

U.S. PATENT DOCUMENTS

| | | | |
|---|---|---|---|
| 3,537,645 | 11/1970 | Treder | 236/92 |
| 3,822,563 | 7/1974 | Orth | 236/92 B X |
| 4,161,278 | 7/1979 | Klann et al. | 236/99 R X |
| 4,542,852 | 9/1985 | Orth et al. | 62/225 X |
| 5,044,170 | 9/1991 | Tanaka | 62/225 |
| 5,044,551 | 9/1991 | Tanaka et al. | 62/225 X |
| 5,127,237 | 7/1992 | Sendo et al. | 62/225 |

*Primary Examiner*—William E. Tapolcai
*Attorney, Agent, or Firm*—Kenyon & Kenyon

[57] ABSTRACT

A power element-valve housing combined type thermal expansion valve has a diaphragm in an element and a driving member for driving a valve body in a housing by a diaphragm deflection. The diaphragm has a center opening surrounded by a tubular projection, the driving member has an outer flange coaxially supporting the diaphragm and a heat-balance containing blind hold opened to a heat sensitive working fluid in a sealed chamber in the element. A diaphragm catch fits on the projection's periphery and is airtightly welded with a coaxial annular ridge on a supporting surface of the flange to sandwich the diaphragm with the flange.

5 Claims, 4 Drawing Sheets

THERMAL EXPANSION VALVE

BACKGROUND OF THE INVENTION

1. Field of the Invention

This invention relates to a thermal expansion valve and, more particularly, to a thermal expansion valve combined with a thermal bulb.

2. Description of the Related Art

A thermal expansion valve is used together with a compressor, a condenser and an evaporator in a refrigeration apparatus using a refrigerant, and controls the flow rate of the refrigerant flowing into the evaporator in response to the temperature of the refrigerant at an outlet port of the evaporator.

A typical thermal expansion valve comprises: a thermal bulb in which a heat sensitive working fluid is sealed and which is located at the outlet of the evaporator and produces a pressure of a gas of the working fluid in response to the temperature of the refrigerant at the outlet port of the evaporator; a power element which has a diaphragm, communicates with the thermal bulb by a capillary tube and activates the diaphragm in response to the pressure of the gas of the working fluid in the thermal bulb; and, a valve housing which is adjacent to and combined with the power element, in which two independent refrigerant flow passages are provided, and which holds a valve body to move relative to a valve seat formed in one refrigerant flow passage and also holds a valve body drive member for transmitting a deflection of the diaphragm of the power element to the valve body to make it sit on and separate from the valve seat in response to the deflection of the diaphragm (that is, the temperature of the refrigerant at the outlet port of the evaporator).

When the conventional thermal expansion valve having such a configuration as described above is used for an air conditioner of an automobile, particularly for a compact car, it is troublesome to install the long and fine capillary tube in a small engine room and the capillary tube is liable to be damaged under a maintenance and repair work in the engine room.

For these reasons, the power element and the thermal bulb are combined with each other in a thermal expansion valve of an automobile air conditioner and does not use any capillary tube. FIG. 3 shows a longitudinal sectional view of the conventional thermal expansion valve of the automobile air conditioner.

In a valve housing 10 of the thermal expansion valve, a first refrigerant passage 14 and a second refrigerant passage 16 are formed independently from each other, and a valve seat 12 is formed in the first refrigerant passage 14. One end of the first refrigerant passage 14 is connected to an inlet port of an evaporator, an outlet port of the evaporator is connected to the other end of the first refrigerand passage 14 by way of the second refrigerant passage 16, an compressor, a condenser and a reservoir.

A valve body 18 is disposed in the first refrigerant passage 14 and is urged to sit on the valve seat 12 by urging means 17. A power element 20 having a diaphragm 19 is fixed to the valve housing 10 and is disposed adjacent to the second refrigerant passage 16. One chamber **20*a* partitioned by the diaphragm 19 in the power element 20** is airtightly sealed and contains a heat sensitive working fluid used in a conventional thermal bulb.

A short capillary tube 21 extending from the sealed chamber **20*a* of the power element 20 is used to degas from or inject the heat sensitive working fluid into the chamber 20*a* and the extended end of the tube 21** is airtightly sealed after the completion of degassing and injection.

In another chamber **20*b* of the power element 20, an extended end of a valve body drive member 22 extending from the valve body 18 through the second refrigerant passage 16 in the valve housing 10 is disposed and abuts the diaphragm 19. The valve body drive member 22 is made of a material having a large heat capacity and transmits heat of a vapor of the refrigerant, flowing out from the outlet port of the evaporator and flowing into the second refrigerant passage 16, to the heat sensitive working fluid in the sealed chamber 20*a* of the power element 20, so that the working fluid provides a working gas having a pressure in response to a temperature of the vapor of the refrigerant. The other chamber 20*b*communicates with the second refrigerant passage 16 within the valve housing 10 by way of a peripheral gap of the valve body drive member 22**.

Thus, under the influence of the urging force of the urging means 17, the diaphragm 19 of the power element 20 controls the degree of the opening of the valve body 18 relative to the valve seat 12 (that is, the flow rate of the liquid refrigerant flowing into the inlet port of the evaporator) in response to the difference between the pressure of the gas of the heat sensitive working fluid in the sealed chamber **20*a* of the power element 20 and that of the refrigerant vapor in the other chamber 20*b*** or in the outlet port of the evaporator (it is considered that the pressure difference is in proportion to the degree of superheat defined by a difference between the temperature of the refrigerant vapor at the outlet port of the evaporator and that of evaporation of the refrigerant in the evaporator).

This conventional combined type thermal expansion valve can be easily installed in the air conditioner of the automobile, particularly the compact car. But, since the sealed chamber **20*a* of the power element 20 projects into the space of the engine room, the heat sensitive working fluid in the sealed chamber 20*a* is influenced by not only the temperature of the refrigerant vapor at the outlet port of the evaporator, transmitted through the valve body drive member 22**, but also the temperature of the atmosphere in the engine room.

Therefore, the thermal expansion valve influenced by the atmosphere can not fully work its function.

FIG. 4 shows a thermal expansion valve proposed in U.S. Pat. No. 3,537,645 and improved to eliminate the above disadvantages of the above described conventional thermal expansion valve.

The same components of the improved thermal expansion valve of FIG. 4 as those of the valve of FIG. 3 are indicated by the same reference numerals as those of FIG. 3 and their detailed description will be omitted here.

In the improved conventional thermal expansion valve, an end portion of the valve body drive member 22 located adjacent to the diaphragm 19 is inserted into an opening formed in a center of the diaphragm 19 and is firmly fixed to the central opening of the diaphragm 19. A blind hole **22*a* is bored in an end surface of the end portion of the valve body drive member 22 to open to the sealed chamber 20*a* of the power element 20. Since the heat sensitive working fluid in the sealed chamber 20*a* of the power element 20 can flow into and flow out from the blind hole 22***a* of the valve body drive member 22, the working fluid functions in greatly response to the temperature of the refrigerant vapor at the outlet port of the evaporator than in response to the temperature of the atmosphere in the engine room.

The improved conventional thermal expansion valve, however, is too sensitive to and excessively respond to the temperature of the refrigerant vapor at the outlet port of the evaporator, so that it makes the valve body 18 frequently move between opening and closed positions (a "hunting" phenomenon). Such a phenomenon makes the performance of the air conditioner be unstable and significantly reduces its efficiency.

Further, in the improved conventional thermal expansion valve, an airtight sealing at the fixing between the central opening of the diaphragm 19 and the corresponding end of the valve body drive member 2 and consequent reduction in the durability of the diaphragm 19 are in trouble.

FIG. 5 shows an enlarged view of the fixing between the central opening of the diaphragm 19 and the corresponding end of the valve body drive member 22. A step is formed in the outer peripheral surface of the end portion of the valve body drive member 22. A diaphragm support member 22*b* is stacked on the step, and the peripheral portion of the central opening of the diaphragm 19 and a diaphragm catch 22*c* are placed successively on the diaphragm support member 22*b*, and an airtight of the central opening of the diaphragm 19 is produced by welding a peripheral edge 22*d* of the diaphragm catch 22*c* to the surface of the diaphragm 19.

If the welding is carried out sufficiently to ensure the airtight, the inner peripheral edge of the thin diaphragm 19 surrounding the central opening tends to become brittle by heat due to the welding. Consequently, the inner peripheral edge of the diaphragm 19 surrounding the central opening is fatigued and is broken easily after a relatively small number of its deflection.

The improved conventional thermal expansion valve as described above is, therefore, still defective in terms of durability and such thermal expansion valves are not actually used.

SUMMARY OF THE INVENTION

According to the present invention, the above object is achieved by providing a thermal expansion valve comprising: a valve housing in which a first refrigerant passage, having a valve seat and adapted to communicate with a refrigerant inlet port of an evaporator, and a second refrigerant passage, being independent of the first refrigerant passage and adapted to communicate with a refrigerant outlet port of the evaporator, are formed; a valve body which is disposed in the valve housing to freely sit on and separate from the valve seat; valve body urging means for urging the valve body toward the valve seat in the valve housing; a power element which is disposed adjacent to the valve housing and has a diaphragm partitioning an inner space into a heat sensitive working chamber and a refrigerant vapor working chamber, the heat sensitive working chamber being holding a heat sensitive working fluid in a sealed manner and the refrigerant vapor working chamber being independent of the heat sensitive working chamber and communicating with the second refrigerant passage; a valve body drive member which is fixed to the center of the diaphragm of the power element, is exposed to the second refrigerant passage, has a blind hole opened to the heat sensitive working chamber of the power element and transmits a deflection of the diaphragm to the valve body to make the valve body sit on and separate from the valve seat; and a heat ballast which is contained in the blind hole of the valve body drive member and retards at least the rate of gas pressure rise of the heat sensitive working fluid in the heat sensitive working chamber caused by the temperature rise of the refrigerant vapor flowing in the second refrigerant passage at the refrigerant outlet port of the evaporator; wherein a diaphragm support member extending in a radial direction of the valve body drive member is mounted on an end portion of the valve body drive member closer to the heat sensitive working chamber, an annular ridge surrounding the blind hole in the end portion of the valve body drive member and a pair of annular escape grooves running respectively along the outer and inner peripheral edges of the annular ridge are formed on a diaphragm side surface of the diaphragm support member, a central opening is formed in a center of the diaphragm to correspond to the blind hole in the end portion of the valve body drive member, an inner peripheral portion of the diaphragm surrounding the central opening constructs a tubular projection extending along a center line of the central opening to leave far away from an end surface of the end portion of the valve body drive member, an annular diaphragm catch is fitted on an outer peripheral surface of the tubular projection of the diaphragm, the diaphragm catch cooperates with the diaphragm support member at the end portion of the valve body drive member to sandwich the inner peripheral portion of the diaphragm surrounding the central opening, and the diaphragm catch, the inner peripheral portion of the diaphragm surrounding the central opening and the diaphragm support member of the valve body drive member are airtightly welded each other at a projecting end of the annular projection of the diaphragm support member.

In the thermal expansion valve characterized by being constructed as described above in accordance with the present invention, the power element holding the heat sensitive working fluid in its heat sensitive working chamber and functioning as a thermal bulb and the valve housing are disposed adjacent to each other and the thermal expansion valve has no capillary tube, so that the thermal expansion valve can be easily installed in a narrow space such as an engine room of an automobile.

Additionally, since the heat ballast contained in the blind hole of the valve body drive member retards at least the rate of gas pressure rise of the heat sensitive working fluid in the heat sensitive working chamber caused by the temperature rise of the refrigerant vapor flowing in the second refrigerant passage at the refrigerant outlet port of the evaporator suppresses a hunting phenomenon, the air conditioner operates stably and the opening efficiency of the air conditioner can be increased.

Finally, since an inner peripheral portion of the diaphragm surrounding the central opening which is airtightly welded with the diaphragm catch and the diaphragm support member of the valve body drive member is sandwiched by the diaphragm catch and the diaphragm support member of the valve body drive member, the inner peripheral portion of the diaphragm surrounding the central opening that has been adversely affected by heat during the welding is reinforced by the diaphragm catch and the diaphragm support member of the valve body drive member. Thus, the diaphragm is free from any heat fatigue and the thermal expansion valve can be used for a long period of time.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENT

Now, a thermal expansion valve according to one embodiment of the present invention will be described in detail with reference to FIGS. 1, 2A and 2B of the accompanying drawings.

Figure 3:
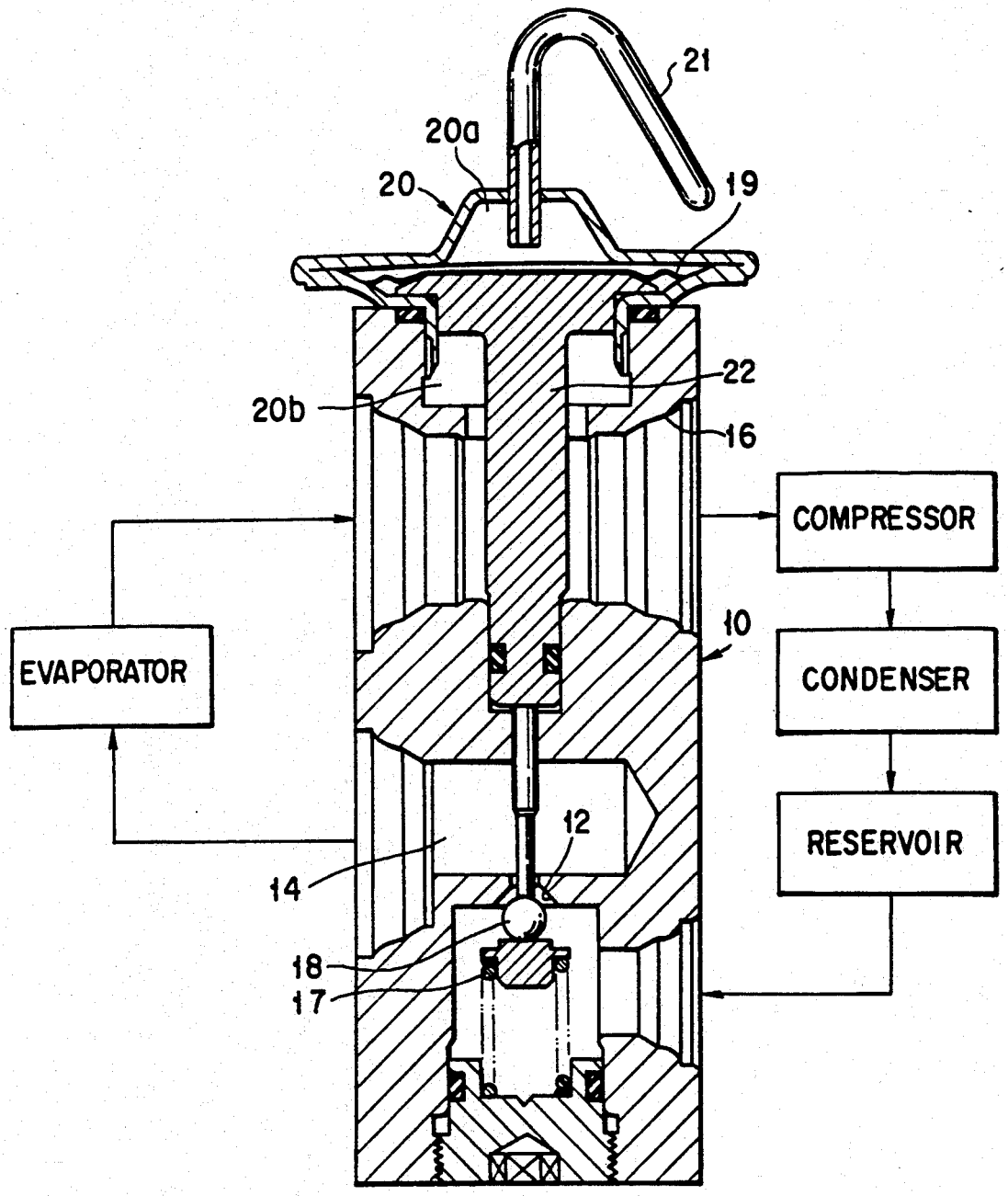
PRIOR ART FIG. 3
FIG. 3 is a longitudinal sectional view of a conventional thermal expansion valve.
Figure 4:
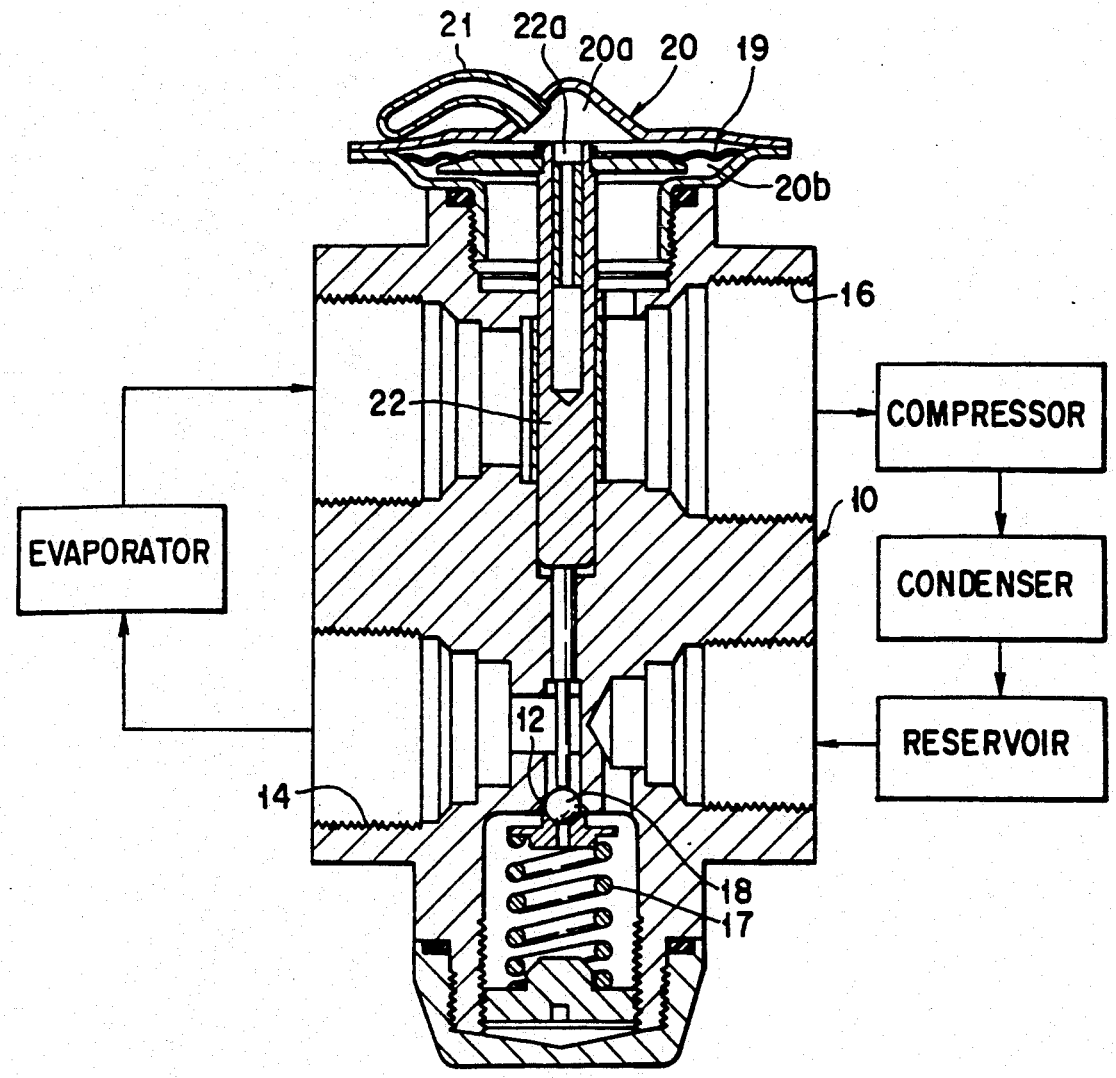
PRIOR ART FIG. 4
FIG. 4 is a longitudinal sectional view of an improved conventional thermal expansion valve, which is not used actually.
Figure 5:
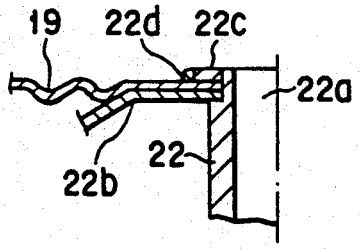
PRIOR ART FIG. 5
FIG. 5 is an enlarged longitudinal sectional view of the thermal expansion valve of FIG. 4, showing a fixing construction between a the central opening of a diaphragm and an outer peripheral surface of an end portion of a valve body drive member by an airtightly welding in the thermal expansion valve of FIG. 4.

The same components of the embodiment a those of the conventional thermal expansion valves shown in FIGS. 3 and 4 are indicated by the same reference numerals as those of their counterparts in FIGS. 3 and 4 and will not be described in detail.

Figure 1:
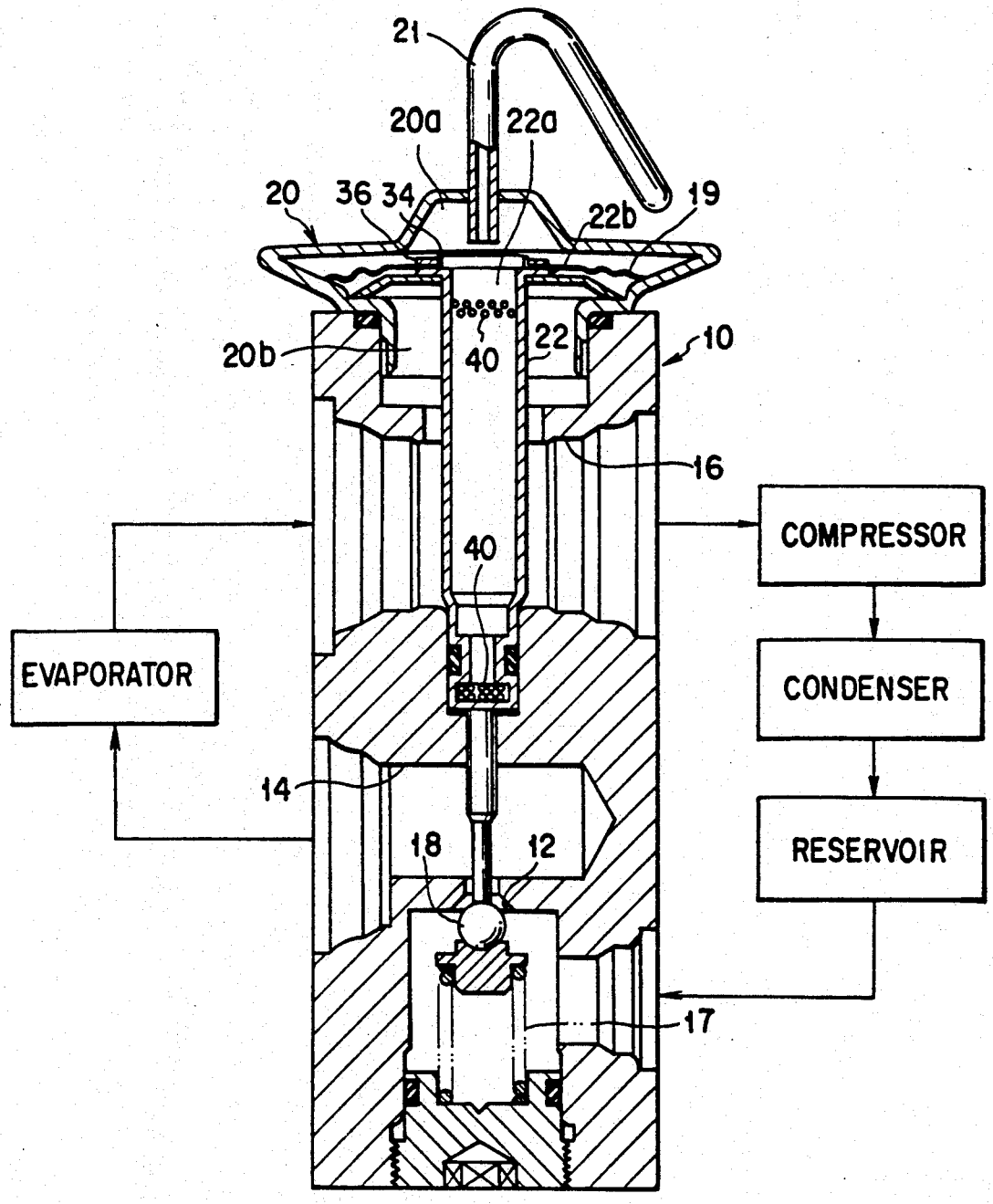
FIG. 1 is a longitudinal sectional view of a thermal expansion valve according to one embodiment of the invention.

Note that the embodiment of FIG. 1 is different from the conventional thermal expansion valve of FIG. 4 only in the fixing construction between the central opening of the diaphragm 19 and the end portion of the valve body drive member 22 on the side of the diaphragm 19 by the sealing welding, and the rest of the embodiment is basically the same as that of the thermal expansion valve of FIG. 4.

Figure 2A:
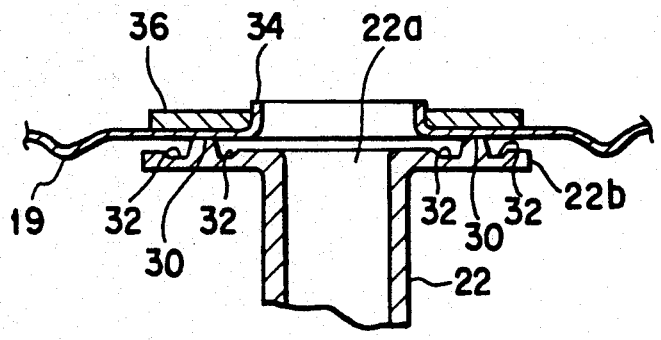
FIG. 2A is an enlarged longitudinal sectional view showing a state in which an inner peripheral portion of a diaphragm surrounding a central opening is sandwiched by a diaphragm support member of an end portion of a valve body drive member and a diaphragm catch just before they are airtightly welded.
Figure 2B:
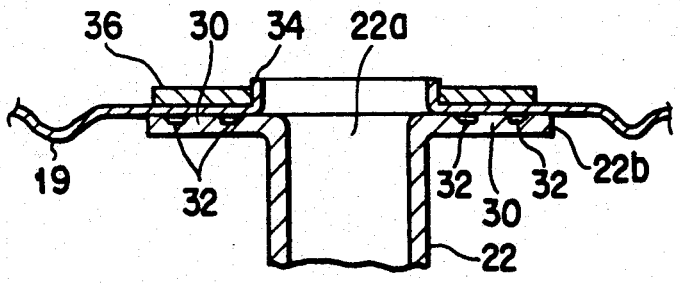
FIG. 2B is an enlarged longitudinal sectional view showing a state in which the diaphragm support member of the end portion of the valve body drive member and the diaphragm catch of FIG. 2A are airtightly welded together.

As clearly shown in FIG. 2A, an annular ridge 30 is formed on a diaphragm side surface of the diaphragm support member 22*b* at the end portion of the valve body drive member 22 to surround the blind hole 22*a* which is opened at the end surface of the end portion of the support member 22*b*. A pair of annular grooves 32 are formed respectively along the outer and inner peripheral edges of the foot of the annular ridge 30 on the diaphragm side surface of the diaphragm support member 22*b*.

The diaphragm side surface of the diaphragm support member 22*b* at the end portion of the valve body drive member 22 supports a central portion of the diaphragm 19, and the inner peripheral portion of the diaphragm 19 surrounding the central opening constructs a tubular projection 34 extending coaxially with and along a center line of the blind hole 22*a*, formed at the end surface of the end portion of the valve body drive member 22, to leave far away from the end surface of the end portion of the valve body drive member 22.

An annular diaphragm catch 36 is fitted on the outer peripheral surface of the tubular projection 34 of the diaphragm 19. The inner peripheral surface of the diaphragm catch 36 has the substantially same diameter as that of the outer peripheral surface of the tubular projection 34, and the diaphragm catch 36 cooprates with the diaphragm support member 22*b* to sandwich a peripheral region of the foot of the tubular projection 34 of the diaphragm 19 (that is, the inner peripheral portion surrounding the central opening).

The diaphragm catch 36 and the diaphragm support member 22*b* are coaxially sandwiched by annular positive and negative electrodes (not shown) having the same diameter as that of the annular ridge 30 of the diaphragm support member 22*b* and are applied with a predetermined magnitude of voltage through the electrodes, so that the diaphragm catch 36, the peripheral region of the foot of the tubular projection 34 of the diaphragm 19 (that is, the inner peripheral portion surrounding the central opening) and the diaphragm support member 22*b* are airtightly welded together.

Due to the above described welding, a top end of the annular ridge 30 of the diaphragm 19, a corresponding annular portion on the inner peripheral portion of the diaphragm 19 and a corresponding annular portion of the diaphragm catch 36 are melted. The molten metal material flows into the annular escape groove 32 formed along the outer and inner peripheral edges of the boot of the annular ridge 30 of the diaphragm support member 22*b* and therefore, as clearly illustrated in FIG. 2B, is prevented from hindering any close contact of the diaphragm side surface of the diaphragm support member with the inner peripheral portion of the diaphragm 19 and close contact of the inner peripheral portion of the diaphragm 19 with the diaphragm catch 36.

Since the annular portion of the inner peripheral portion of the diaphragm 19, which corresponds to the annular ridge 30 of the diaphragm support member 22*b* and is adversely affected by heat of the welding, is reinforced by the diaphragm catch 36 and the diaphragm support member 22*b*, the thermal expansion valve can enjoy a long service life without breakage of the diaphragm 19.

In this embodiment, a housing 36 (FIG. 1) of the power element 20 and the diaphragm 19 are made of a stainless steel defined as SUS304 by JIS (Japanese Industrial Standard) and the tubular projection 34 of the diaphragm 19 has a height of approximately 1.5 mm.

A heat ballast 40 such as particulate active carbon or sintered alumina silica is contained in the blind hole 22*a* bored in the end surface of the end portion of the valve body drive member 22.

$CF_4$ (Freon 14) is used as the heat sensitive working fluid sealed in the chamber 20*a* of the power element 20 when particle active carbon is used as the heat ballast 40, and Freon 134*a* which is commonly used for the refrigerant in a refrigeration system is used as the heat sensitive working fluid when the sintered alumina silica is used as the heat ballast 24.

A combination of the heat sensitive working fluid of $CF_4$ (Freon 14) and the heat ballast 40 of the active carbon is an adsorption equilibrium type, and a pressure generated from the combination can be approximated by a linear expression of temperature over a considerably wide temperature range. Since a coefficient of the linear expression can be set to a desired value by appropriately determining the volume of the particulate active carbon to be sealed, the user of the thermal expansion valve can set desirably the performance of the thermal expansion valve.

A considerable period of time is required to set a pressure-temperature equilibrium in the adsorption equilibrium type in both cases that the temperature of the refrigerant vapor flowing out of the outlet port of the evaporator is rising (and the degree of superheat is rising) and that is falling (and the degree of superheat is falling). This suppresses the excessively sensible action of the thermal expansion valve to ensure a stable operation of the air conditioner and consequently raise its operating efficiency.

Alternatively, sintered alumina silica and Freon 134*a* which is normally used as the refrigerant of a refrigeration system may be respectively used for the heat ballast 24 and the heat sensitive working fluid sealed in the chamber 20*a* of the 1 power element 20.

A combination of the heat ballast 24 of the sintered alumina silica and the heat sensitive working fluid of Freon 134*a* is a gas-liquid equilibrium type. With such a combination, since the heat sensitive working fluid is enterned into fine pores of the heat ballast 24, the transition from a liquid phase to a gas phase (gasification) of the heat sensitive working fluid is retarded when the temperature of the refrigerant vapor flowing out of the outlet port of the evaporator is rising (the degree of superheat is rising). And a rapid transition from a gas phase to a liquid phase (liquefaction) of the working gas in the chamber 20*a* and the blind hole 22*a* other than the gas in the fine pores of the heat ballast 24 is not hindered on the wall surfaces of the chamber 20*a* and the blind hole 22*a*. In other words, the flow rate of the refrigerant flowing into the inlet port of the evaporator is raised gradually when the degree of superheat is rising, and it is lowered rapidly when the degree of superheat is falling. Thus, an air conditioner using the thermal expansion valve of the gas-liquid equilibrium type has a higher cooling capacity than that of the adsorption equilibrium type during a certain period of time immediately after the start of operation. Moreover, after reaching a stabilized stage of operation, the thermal expansion valve of the gas-liquid equilibrium type is prevented from excessively sensitive acting caused by the influence of disturbance, so that the air conditioner can stably operates and consequently its operating efficiency raises as in the case of that of the adsorption equilibrium type.

The the diaphragm support member 22*b* is integrally formed with the diaphragm side end portion of the valve body drive member 22 in the above embodiment, but it may be independent by formed of the end portion of the drive member 22 and then secured thereto.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A thermal expansion valve comprising:

a valve housing in which a first refrigerant passage, having a valve seat and adapted to communicate with a refrigerant inlet port of an evaporator, and a second refrigerant passage, being independent of the first refrigerant passage and adapted to communicate with a refrigerant outlet port of the evaporator, are formed;

a valve body which is disposed in said valve housing to freely sit on and separate from the valve seat;

valve body urging means for urging said valve body toward the valve seat in said valve housing;

a power element which is disposed adjacent to said valve housing and has a diaphragm partitioning an inner space of said power element into a heat sensitive working chamber and a refrigerant vapor working chamber, the heat sensitive working chamber being holding heat sensitive working fluid in a sealed manner and the refrigerant vapor working chamber being independent of the heat sensitive working chamber and being communicating with the second refrigerant passage;

a valve body drive member which is fixed to the center of the diaphragm of said power element, is exposed to the second refrigerant passage, has a blind hole opened to the heat sensitive working chamber of said power element, and transmits a deflection of the diaphragm to said valve body to make said valve body sit on and separate from the valve seat; and a heat ballast which is contained in the blind hole of said valve body drive member and retards at least the rate of gas pressure rise of the heat sensitive working fluid in the heat sensitive working chamber, caused by the temperature rise of the refrigerant vapor flowing in the second refrigerant passage at the refrigerant outlet port of the evaporator;

wherein a diaphragm support member extending in a radial direction of said valve body drive member is mounted on an end portion of said valve body drive member closer to the heat sensitive working chamber, an annular ridge surrounding the blind hole in the end portion of said valve body drive member and a pair of annular escape grooves running respectively along the outer and inner peripheral edges of the annular ridge are formed on a diaphragm side surface of said diaphragm support member, a central opening is formed in a center of the diaphragm to correspond to the blind hole in the end portion of said valve body drive member, an inner peripheral portion of the diaphragm surrounding the central opening constructs a tubular projection extending along a center line of the central opening to leave far away from an end surface of the end portion of said valve body drive member, an annular diaphragm catch is fitted on an outer peripheral surface of the tubular projection of the diaphragm, said diaphragm catch cooperates with said diaphragm support member at the end portion of said valve body drive member to sandwich the inner peripheral portion of the diaphragm surrounding the central opening, and said diaphragm catch, the inner peripheral portion of the diaphragm surrounding the central opening and said diaphragm support member of said valve body drive member are airtightly welded each other at a projecting end of the annular projection of said diaphragm support member.

2. A thermal expansion valve according to claim 1, wherein a diaphragm support member is disposed on the outer peripheral surface of the end portion of said valve body drive member close to the diaphragm and a base end portion of the tubular projection of the diaphragm is stacked on the diaphragm support member and is supported by the support member.

3. A thermal expansion valve according to claim 1, wherein said heat ballast is particulate active carbon which retards not only the rate of gas pressure rise of the heat sensitive working fluid in the heat sensitive working chamber caused by the temperature rise of the refrigerant at the refrigerant outlet port of the evaporator in the second refrigerant passage but also the rate of gas pressure fall of the heat sensitive working fluid in the heat sensitive working chamber caused by the temperature fall of the refrigerant at the refrigerant outlet port of the evaporator in the second refrigerant passage.

4. A thermal expansion valve according to claim 3, wherein the heat sensitive working fluid is $CF_4$, or Freon 14.

5. A thermal expansion valve according to claim 1, wherein said heat ballast is sintered alumina silica which retards the rate of transition of the heat sensitive working fluid entered in fine pores of said heat ballast from a liquid phase to a gas phase during the temperature rise of the refrigerant at the refrigerant outlet port of the evaporator in the second refrigerant passage, and does not hinder rapid transition of the heat sensitive working fluid from the gas phase to the liquid phase in the heat sensitive working chamber and the blind hole other than said heat on their wall surfaces during the temperature fall of the refrigerant a the above described outlet port in the second passage.

* * * * *

UNITED STATES PATENT AND TRADEMARK OFFICE

CERTIFICATE OF CORRECTION

PATENT NO. : 5,228,619

DATED : 20 July 1993

INVENTOR(S) : Masamichi YANO et al.

It is certified that error appears in the above-indentified patent and that said Letters Patent is hereby corrected as shown below:

IN THE ABSTRACT: Line 7, please change "hold" to --hole--.

| Column | Line | |
|---|---|---|
| 1 | 57 | Change "refrigerand" to --refrigerant--. |
| 1 | 58 | Change "an" to --a--. |
| 2 | 20 | Change "20*b*communicates" to --20*b* communicates--. |
| 2 | 39 | After "of" change "the" to --an--. |
| 2 | 40 | After "particularly" change "the" to --a--. |
| 3 | 2 | Change "functions in greatly" to --functions greater in--. |
| 3 | 7 | Change "respond" to --responds--. |
| 3 | 12 | After "airconditioner" delete "be". |

UNITED STATES PATENT AND TRADEMARK OFFICE

CERTIFICATE OF CORRECTION

PATENT NO. : 5,228,619

DATED : 20 July 1993

INVENTOR(S) : Masamichi YANO et al.

It is certified that error appears in the above-indentified patent and that said Letters Patent is hereby corrected as shown below:

| Column | Line | |
|---|---|---|
| 3 | 17 | Change "2" to --22--; delete "and" and insert --is impaired, causing a--. |
| 3 | 19 | After "19" delete "are in trouble". |
| 3 | 29 | After "airtight" insert --seal--. |
| 3 | 32 | After "ensure" change "the" to --an--. |
| 3 | 33 | After "airtight" insert --seal--. |
| 3 | 38 | Change "its deflection." to --deflections--. |
| 3 | 61 | Delete "being". |
| 4 | 25 | Change "leave" to --terminate--. |
| 4 | 36 | After "welded" insert --to--. |
| 5 | 40 | After "between" delete "a". |

UNITED STATES PATENT AND TRADEMARK OFFICE

CERTIFICATE OF CORRECTION

PATENT NO. : 5,228,619

DATED : 20 July 1993

INVENTOR(S) : Masamichi YANO et al.

It is certified that error appears in the above-indentified patent and that said Letters Patent is hereby corrected as shown below:

| Column | Line | |
|---|---|---|
| 5 | 42 | Change "airtightly" to --airtight--. |
| 5 | 51 | Change "a" to --as--. |
| 6 | 10 | Change "constructs" to --creates--. |
| 6 | 14 | Change "leave" to --terminate--. |
| 6 | 21 | Change "cooprates" to --cooperates--. |
| 6 | 42 | Change "groove" to --grooves--. |
| 7 | 21 | Change "cases that" to --cases: when--. |
| 7 | 24 | Change "that" to --when it--. |
| 7 | 25 | Change "sensible" to --sensitive--. |
| 7 | 33 | Before "power" unbold "1". |
| 7 | 38 | Change "enterned" to --entrained--. |

UNITED STATES PATENT AND TRADEMARK OFFICE

CERTIFICATE OF CORRECTION

PATENT NO. : 5,228,619

DATED : 20 July 1993

INVENTOR(S) : Masamichi YANO et al.

It is certified that error appears in the above-indentified patent and that said Letters Patent is hereby corrected as shown below:

| Column | Line | |
|---|---|---|
| 7 | 61 | Change "operates" to --operate--. |
| 7 | 64 | Delete "the". |
| 7 | 67 | Change "independent by formed" to --formed independently--. |
| 8 | 27 | Delete "being". |
| 8 | 30 | Before "communicating" delete "being". |
| 8 | 66 | Change "leave" to --terminate--. |
| 9 | 12 | After "welded" insert --to--. |
| 10 | 23 | After "refrigerant" change "a" to --at--. |

Signed and Sealed this

Fifth Day of July, 1994

Bruce Lehman

*Attest:*

BRUCE LEHMAN

*Attesting Officer*

*Commissioner of Patents and Trademarks*